United States Patent [19]

Fabbri et al.

[11] 4,453,956

[45] Jun. 12, 1984

[54] RECOVERING CONDENSABLES FROM NATURAL GAS

[75] Inventors: Cesare Fabbri; Gianfranco Bellitto, both of Milan; Giuseppe La Mantia, Cassano d'Adda; Biagio Failla, Milan, all of Italy

[73] Assignee: Snamprogetti S.p.A., Milan, Italy

[21] Appl. No.: 390,686

[22] Filed: Jun. 21, 1982

[30] Foreign Application Priority Data

Jul. 7, 1981 [IT] Italy ..... 22779 A/81

[51] Int. Cl.[3] ..... F25J 3/02

[52] U.S. Cl. ..... 62/18; 62/28; 62/29; 62/31; 62/33; 62/34; 62/39; 62/43; 62/44

[58] Field of Search ..... 62/9, 11, 17, 18, 19, 62/23, 24, 27, 28, 29, 31, 32, 33, 34, 42, 43, 44, 38, 39, 12, 13

[56] References Cited

U.S. PATENT DOCUMENTS 3,111,042 11/1963 Cunningham ..... 62/27

3,702,541 11/1972 Randall et al. ..... 62/28

4,152,129 5/1979 Trentman et al. ..... 62/28

*Primary Examiner*—Frank Sever

[57] ABSTRACT

To recover condensates from natural gas the raw gas is sent to a high-pressure separator (4) and the incondensable gas is sent to the first stage of an expansion turbine (16) and expanded to a pressure nearly equal to that of the head of a fractionation column (25, 28, 29) composed of three sections, top (25), intermediate (29) and bottom (28). The liquids from the separator (4) are expanded in a second separator (14) and fed to the bottom section (28). The gas from the second separator (14) is mixed with the exhaust from the first turbine stage (16) and fed to the lower portion of the top section (25) to the head of which there is sent the liquid issuing from the intermediate section (29). The latter receives the exhaust from the second turbine stage (36) which is fed by the gas from the top section (25) head. The liquid on the bottom of the top section (25) is fed to the bottom section (28). The residual gas is drawn from the top of the intermediate section (29) is compressed by the coaxial compressor to the turbine whereas the condensates are drawn from the bottom section (28).

3 Claims, 1 Drawing Figure

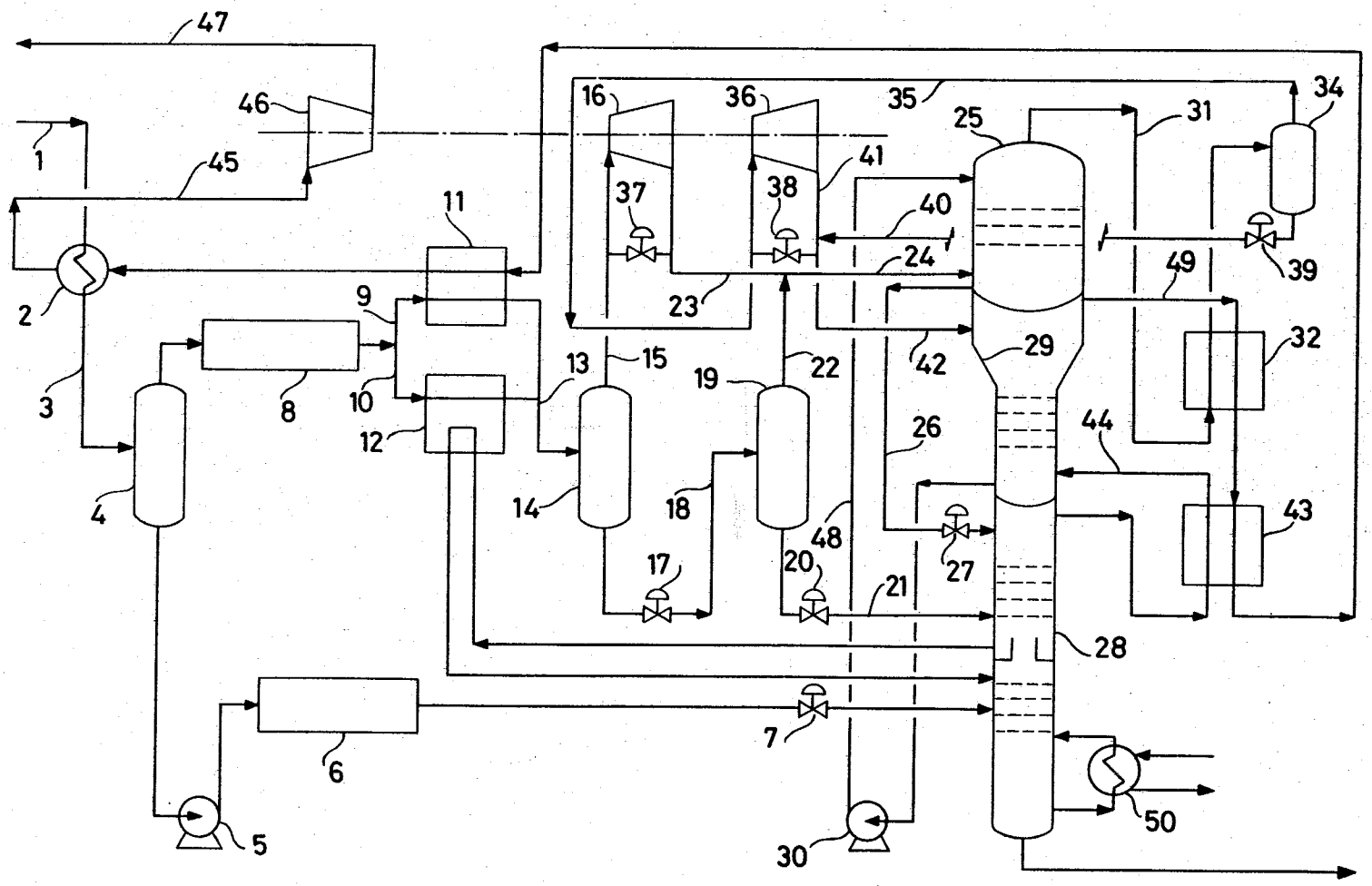
34
39
32
43
31
49
44
28
50
29
25
27
35
40
24
42
26
21
41
48
22
20
38
36
19
7
30
23
18
17
15
37
16
13
14
11
12
9
10
8
6
46
45
47
5
4
1
2
3

RECOVERING CONDENSABLES FROM NATURAL GAS

This invention relates to a novel process for recovering condensable hydrocarbons, such as ethane, propane, butanes and higher homologs from a gaseous stream consisting of natural gas.

More particularly, the novel method in question is very efficient and functional for recovering propane and higher homologs.

A number of procedures are known for recovering natural gas condensables, a few of these methods exploiting expansion turbines for producing the low temperatures which are required for condensing the gas and subsequently fractioning the condensates.

The method according to the present invention differs from the known processes due to the particular arrangement of the machinery and the different flowsheet, which are conducive to efficient heat recovery and an improved fractionation, so that considerable quantities of condensable hydrocarbons can be recovered with a minimum power expenditure.

An exemplary embodiment of the invention will now be described with reference to the single FIGURE of the accompanying drawing, in order that the invention may be best understood.

The raw gas, under a comparatively high pressure, enters, via the line 1, the heat exchanger 2, wherein a first cooling takes place down to temperatures which are above the temperature of formation of hydrates, this cooling being a function of the composition of the gas stream and of its pressure. Through the line 3, the gas enters the separator 4, wherein the condensate is separated from the gas phase and is pumped by the pump 5 through the solid-dryer beds 6, whereafter the gas stream is fed, via the regulation valve 7, to the bottom section 28 of a fractionation column (25, 29, 28), composed of three sections or trunks 25, 29 and 28 to be better described hereinafter. The gas emerging from the separator 4 is dried over the solid-dryer beds 8.

According to a modification of the instant method, especially when gases having a comparatively low temperature and a low molecular weight, such as gases having a high content of methane, the machinery 4, 5, 6 and 7 can be dispensed with, so that, in such a case, the raw gas can directly feed the drying section 8. The dried gas feeds, via the respective lines 9 and 10, the second gas/gas exchanger 11 and the lateral reboiler 12, respectively, wherein it is further cooled at the expense of the residual cold gas and of a liquid cold stream drawn at an appropriate level of the fractionation column, respectively.

The splitting of the streams between the lines 9 and 10 is carried out by appropriate control devices, not shown in the flowsheet.

According to a few modifications of the present method, instead of using the lateral reboiler 12, negative calories can be recovered from the reboiler 50 and/or by the addition of an external cooling, for example by a propane or Freon refrigeration cycle, as a function of the pressure and the composition of the raw gas and of the degree of recovery requested.

Cooling the gas at 11 and 12 brings about a partial condensation of hydrocarbons, with the attendant formation of a liquid having an average composition which is heavier than that of the vapours in equilibrium. The streams exiting 11 and 12 are combined in the line 13 and feed a high-pressure separator 14, wherein the two phases, the liquid and the solid one, are separated from one another. The high pressure gas (its pressure being slightly below that of the raw gas, due to the pressure drops at 2, 4, 8, 11, 12 and through the connection lines) feeds via the line 15 the first stage of the expansion turbine 16, wherein the gas is expanded down to an appropriate pressure value: this value is between the pressure of the raw gas and that of the residual gas prior to compression.

During the expansion of the gas, a conversion of an isoenthropic type takes place, the efficiency of which is less than the unity, that which brings about a considerable cooling of the gas and the attendant formation of an additional amount of condensates, so that the content of heavier hydrocarbons in the gas in equilibrium is further reduced.

The power evolved by the expansion turbine can be used for the partial compression of the residual gas.

The liquid under high pressure exiting the separator 14 is caused to expand through the regulation valve 17 and is fed via the line 18 to the medium-pressure separator 18 which operates under a pressure slightly above the outlet pressure of the expansion turbine 16.

During progress of this expansion of the liquid, which is of a virtually isoenthalpic nature, two phases are formed, to be separated in 19, viz.: a liquid enriched with the heavier hydrocarbons of the starting liquid, and a gas rich with lighter hydrocarbons.

By such a processing diagram, a preliminary fractionation of the liquid takes place, prior to carrying out the fractionation proper of said liquid, so that the efficiency of the condensate recovery is improved, that which is just an objective of the instant method.

The comparatively cold liquid exiting the separator 19 feeds, via the regulation valve 20 and the line 21, the fractionation column (25, 29, 28) at a section immediately above the section from which the liquid intended to feed the lateral reboiler 12 is drawn.

The gas exiting the separator 19 is combined, through the line 22, with the stream emerging from the expansion turbine 16 (line 23).

The mixture, via the line 24, is fed to the top section 25, of the fractionation column (25, 29, 28), said section being the medium-pressure top section of the column. In this section, the mixture is split into a liquid, which, through the line 26 and the valve 27, is refluxed to the bottom section 28 of the column (a low-pressure bottom section), and vapours, which are scrubbed in counterflow relationship by a liquid stream coming from the intermediate section 29 of the column, which is the intermediate low-pressure section of said column, and is pumped by the pump 30. The contact between the liquid and the vapours takes place with the aid of appropriate plates (foraminous, valved and of other kinds), or packings of various types, which are common to the three sections, 25, 29, 28 of the fractionation column.

By so doing, a first absorption is carried out of the heavier condensables which were contained in the original raw gas.

The gas, thus stripped of the heaviest fractions, emerges from the head of the top section 25 of the fractionation column and, via the line 31, it enters the medium-pressure gas exchanger 32 wherein it is cooled by the gas exiting the low-pressure section 29, so that a further amount of condensate is formed. The mixture now feeds the separator 34 through the line 33.

The gas which has been separated feeds, via the line 35, the second stage of the expansion turbine 36, wherein it is expanded down to an appropriate value of the pressure, which is comparatively low as itself and is a function of the inlet pressure of the original raw gas, of the composition of said gas and of the intensity of recovery of hydrocarbons which is requested from time to time.

Also in this case, similarly to what had been experienced with the first expansion stage 16, a considerable cooling of the gas is achieved, so that still another quantity of condensates is formed.

A characteristic feature of the present invention is that the gas, prior to proceeding with the second expansion in the turbine, is stripped of its heavier components, initially by absorption in the top section of the fractionation column 25, and subsequently by condensation in the exchanger 32, the efficiency of the expansion in the turbine being thus improved.

The work produced by the expansion turbine can be exploited as that of the first stage 16, for the partial compression of the residual gas. The expansion turbines also called turboexpanders, are available on the trade as supplied by specialized constructors, and are usually supplied with a coaxial compressor and with appropriate spaces for regulating the inlet flow.

According to a few modifications of the process as described hereinabove, either expansion stage might be replaced by an expansion valve (37, 38). The liquid exiting the separator 34 is caused to expand through the valve 39 and is combined, via the line 40, with the stream exiting the expansion turbine 36 (line 41). The mixture is now feed through the line 42 to the intermediate section 29 of the fractionation column. The comparatively lightweight liquid which is separated at a low temperature falls into the intermediate section 29 of the column and washes in counterflow relationship the head gas of the bottom section 28 of the fractionation column, after that said gas has been cooled in the exchanger 43 (low pressure gas exchanger) and is fed to the section 29 through the line 44.

The gas coming from the bottom section 28 of the column is thus further stripped of condensable compounds prior to being combined with the gas coming from the stream 42. The mixture of the two gases, which is the residual gas, is preheated in the exchangers 32, 43, 11 and 2, prior to being fed, via the line 45, to the compressor 46 which is coaxial with the expansion turbines.

The residual gas which has thus been partially compressed, is sent, via the line 47, to the final compression stage, if so required, to be brought to the pressure intended for its use.

The final compressor has not been shown in the flowsheet.

As outlined above, the main characteristic feature of the process described herein is that the gas, prior to being passed through the second expansion stage, is stripped by scrubbing in counterflow relationship in the top section of the fractionation column with a lighter liquid which is the condensate of the second expansion stage, after that the same liquid has scrubbed in counterflow in the intermediate section of the fractionation column the gases exiting the bottom section of the fractionation column. Thus, a gradual enlightment of the gas is obtained and very low temperatures are attained for the residual gas in the stream 49, so that the recovery of condensable products is very high.

According to a modification of the process now described, which is a modification using a single stage of the expansion turbine, the gas is directly fed, via the line 13, to the top section 25 of the fractionation column.

In this modification of the process, the machinery 14, 16, 17, 19, 20 is dispensed with.

The bottom section 28 of the fractionation column is fed at its top through the line 26 and the valve 27 with the liquid exiting the top section 25. Section 28, moreover, is fed at an intermediate level by the liquid coming from the separator 19, via the valve 20 and the line 21. The condensates of heavier weight, if any, coming from the drying unit 6 and through the valve 7 are fed to the lower portion of section 28 of the fractionation column. The heat which is required for the production of the stripping vapours for the bottom section 28 is supplied, in the bottom portion, by the reboiler 50, and, in the intermediate portion, that is, below the feeding stream coming via the line 21, by the lateral reboiler 12.

According to a modification of the process in question, more than one lateral reboiler can be provided with a recovery of negative calories to cool the raw gas. The heating means for the reboiler 50 may be any heating fluid such as hot oil, steam, exhaust gases from gas turbines, or, according to still another embodiment of the process, the raw gas itself, or, according to yet another modification, the residual gas after its final compression.

According to a few additional modifications of the process, one or more feeds to the fractionation column can be dispensed with, but the top feed 48 is always present.

The condensate which is produced at the bottom of the fractionation column can be cooled and sent to storage, or it can be used to feed another fractionation section not shown in the flowsheet.

A few values of the operative variables are reported hereinafter by way of example and not for limiting the scope of the present invention.

For example, the pressure of the raw gas at the input line 1 can be between 70 and 40 bars, the gas may contain from 80% to 95% of methane, from 10% to 2% of ethane, from 5% to 2% of propane, and from 2% to 0.5% of butanes, the balance of 100% being composed of pentanes and higher homologs, nitrogen and carbon dioxide.

By way of illustration, a practical example of use of the present invention will be reported hereinafter, in connection of the recovery of propane and higher homologs only.

The raw gas enters under a pressure of 42 bars and at 35° C. with a composition of 82% of methane, 10% of ethane, 4% of propane, 0.8% of isobutane, 1.3% nor. butane, 0.5% of isopentane, and 0.5% of nor.pentane, the balance to 100% being hexane and higher homologs.

The gas is cooled to about 25° C. in the exchanger 2, whereafter it is dehydrated with molecular sieves and is split into two streams: either stream is cooled in the heat exchanger 11 down to −27° C. by the residual gas, the other stream being cooled to −17° C. by the lateral reboiler 12. The gas so cooled enters the separator 14 at about −22° C., whereafter it is expanded in the turbine 16 down to a pressure of about 18 bars and a temperature of −54° C.

The gas coming from the expansion at 16, after having been combined with the gas emerging from the separator 19, is fed to the top section 25 of the fractionation column. The gas exits said top section at −64° C. and is cooled in the exchanger 32 down to −71° C. The gas coming from the separator 34 is fed to the second stage 36 of the expansion turbine and is expanded to a pressure of about 8 bars and a temperature of −91° C., whereupon it is combined with the liquid coming from the separator 34 and feeds the intermediate section 29, of the fractionation column.

The cold liquid scrubs in countercurrent relationship the vapours evolved from the bottom section 28 of the fractionation column and are cooled to −54° C. in the exchanger 43. The vapours exiting the intermediate section 29 of the column have a temperature of −89° C. so that the recovery of the propane entering with the raw gas is 98.2% and that of the heavier compounds is nearly total.

We claim:

1. A process of recovering condensable hydrocarbons from natural gas comprising:

a. indirectly cooling a natural gas feed stream down to a temperature slightly above the temperature at which hydrates are formed:

b. separating condensates from the gas phase of said cooled feed stream of step a;

c. dehydrating and feeding said condensates from step b to the bottom section (28) of a fractionation column (25, 29, 28), said fractionation column consisting of three discrete sections, a top section (25) working under the outlet pressure of a first stage (16) of an expansion turbine, an intermediate section (29) working under the outlet pressure of a second stage (36) of said expansion turbine, and a bottom section (28) working under a pressure slightly above the pressure of said intermediate section (29) so that vapors emerging from said bottom section (28), after a partial condensation, can be sent to the bottom of the intermediate section (29);

d. dehydrating and indirectly cooling said separated gas phase of step b while recovering negative calories from both a residual gas drawn from the intermediate section (29) of said fractionation column (25, 29, 28) and also from a liquid stream drawn from the bottom section (28) of said fractionation column (25, 29, 28);

e. separating condensates from the gas phase of the cooled gas phase of step d;

f. feeding said separated gas phase of step e to the first stage of an expansion turbine (16) with expansion to an intermediate pressure corresponding to that of the head of the top section (25) of said fractionation column (25, 29, 28);

g. expanding said condensates of step e through a valve (17) down to a pressure slightly above the outlet pressure of said first stage of said expansion turbine (16);

h. separating from said condensates stream of step g a liquid stream enriched with the heavier hydrocarbons of the starting liquid and a gas stream rich with lighter hydrocarbons and feeding said liquid stream into the bottom (28) of said fractionation column (25, 29, 28);

i. mixing said gas stream of step h with the gas stream of step f and feeding said mixture of gases to the bottom of the top section (25) of the fractionation column (25, 29, 28);

j. withdrawing liquid stream from the intermediate section (29) and pumping said liquid stream into the top section (25) of said fractionation column (25, 29, 28);

k. indirectly cooling gas exiting said top section (25) of said fractionation column (25, 29, 28) with cold residual gas drawn from said intermediate section (29) of said fractionation column (25, 29, 28);

l. separating from said cooled gas of step k liquid condensates and a gas stream;

m. feeding said gas stream of step l to said second stage (36) of said expansion turbine;

n. mixing the expanded gas stream of step m and the liquid condensates of step l and feeding the mixture into an upper section of said intermediate section (29) of said fractionation column (25, 29, 28);

o. withdrawing gas produced in the bottom section (28) of said fractionation column (25, 29, 28) and indirectly cooling said gas with residual gas from the top portion of the intermediate section (25) before feeding said cooled gas to the lowest portion of said intermediate section (29) of said fractionation column (25, 29, 28);

p. withdrawing from said intermediate section (29) of said fractionation column (25, 29, 28) said residual gas;

q. indirectly heating said residual gas of step p by yielding negative calories to: (1) said gas existing in said top section (25) of said fractionation column (25, 29, 28) of step k; (2) said gas of step o withdrawn from the bottom section (28) of said fractionation column (25, 29, 28); (3) said cooled separated gas phase of step d; and (4) said natural gas feed stream of step a; and r. fractionating in the bottom section (28) of said fractionation column (25, 29, 28) liquids coming from the top section (25), the liquid stream of step h, and the condensates of step c, the heat required for the fractionation being supplied by a bottom reboiler (50) and by one or more lateral reboilers (12).

2. A process of recovering condensable hydrocarbons from natural gas comprising:

a. indirectly cooling a natural gas feed stream down to a temperature slightly above the temperature at which hydrates are formed;

b. separating condensates from the gas phase of said cooled feed stream of step a;

c. dehydrating and feeding said condensates from step b to the bottom section (28) of a fractionation column (25, 29, 28), said fractionation column consisting of three discrete sections, a top section (25) working under the outlet pressure of a first stage (16) of an expansion turbine, an intermediate section (29) working under the outlet pressure of a second stage (36) of said expansion turbine, and a bottom section (28) working under a pressure slightly above the pressure of said intermediate section (29) so that vapors emerging from said bottom section (28), after a partial condensation, can be sent to the bottom of the intermediate section (29);

d. dehydrating and cooling said separate gas phase of step b while recovering negative colories from a residual gas drawn from the intermediate section (29) of said fractionation column (25, 29, 28) and from other sources of negative calories selected from a bottom reboiler (50) of the fractionation column (25, 29, 28), a lateral reboiler (12) of the fractionation column (25, 29, 28), and a refrigeration cycle selected from a propane and Freon refrigeration cycle, connected to each other in series and/or in parallel as a function of the characteristics of the natural gas feed stream.

e. separating condensates from the gas phase of the cooled gas phase of step d;

f. feeding said separated gas phase of step e to the first stage of an expansion turbine (16) with expansion to an intermediate pressure corresponding to that of the head of the top section (25) of said fractionation column (25, 29, 28);

g. expanding said condensates of step e through a valve (17) down to a pressure slightly above the outlet pressure of said first stage of said expansion turbine (16);

h. separating from said condensates stream of step g a liquid stream enriched with the heavier hydrocarbons of the starting liquid and a gas stream rich with lighter hydrocarbons and feeding said liquid stream into the bottom (28) of said fractionation column (25, 29, 28);

i. mixing said gas stream of step h with the gas stream of step f and feeding said mixture of gases to the bottom of the top section (25) of the fractionation column (25, 29, 28);

j. withdrawing liquid stream from the intermediate section (29) and pumping said liquid stream into the top section (25) of said fractionation column (25, 29, 28);

k. indirectly cooling gas exiting said top section (25) of said fractionation column (25, 29, 28) with cold residual gas drawn from said intermediate section (29) of said fractionation column (25, 29, 28);

l. separating from said cooled gas of step k liquid condensates and a gas stream;

m. feeding said gas stream of step l to said second stage (36) of said expansion turbine;

n. mixing the expanded gas stream of step m and the liquid condensates of step l and feeding the mixture into an upper section of said intermediate section (29) of said fractionation column (25, 29, 28);

o. withdrawing gas produced in the bottom section (28) of said fractionation column (25, 29, 28) and indirectly cooling said gas with residual gas from the top position of the intermediate section (25) before feeding said cooled gas to the lowest portion of said intermediate section (29) of said fractionation column (25, 29, 28);

p. withdrawing from said intermediate section (29) of said fractionation column (25, 29, 28) said residual gas;

q. indirectly heating said residual gas of step p by yielding negative calories to: (1) said gas existing in said top section (25) of said fractionation column (25, 29, 28) of step k; (2) said gas of step o withdrawn from the bottom section (28) of said fractionation column (25, 29, 28); (3) said cooled separated gas phase of step d; and (4) said natural gas feed of step a; and r. fractionating in the bottom section (28) of said fractionation column (25, 29, 28) liquids coming from the top section (25), the liquid stream of step h, and the condensates of step c, the heat required for the fractionation being supplied by a bottom reboiler (50) and by one or more lateral reboilers (12).

3. A process of recovering condensable hydrocarbons from natural gas comprising:

a. indirectly cooling a natural gas feed stream down to a temperature slightly above the temperature at which hydrates are formed:

b. separating condensates from the gas phase of said cooled feed stream of step a;

c. dehydrating and feeding said condensates from step b to the bottom section (28) of a fractionation column (25, 29, 28), said fractionation column consisting of three discrete sections, a top section (25) working under the outlet pressure of a first stage (16) of an expansion turbine, an intermediate section (29) working under the outlet pressure of a second stage (36) of said expansion turbine, and a bottom section (28) working under a pressure slightly above the pressure of said intermediate section (29) so that vapors emerging from said bottom section (28), after a partial condensation, can be sent to the bottom of the intermediate section (29);

d. dehydrating and indirectly cooling said separated gas phase of step b while recovering negative calories from both a residual gas drawn from the intermediate section (29) of said fractionation column (25, 29, 28) and also from a liquid stream drawn from the bottom section (28) of said fractionation column (25, 29, 28);

e. separating condensates from the gas phase of the cooled gas phase of step d;

f. expanding said condensates of step e through a valve (17) down to a pressure slightly above the outlet pressure of said first stage of said expansion turbine (16);

g. separating from said condensates stream of step f a liquid stream enriched with the heavier hydrocarbons of the starting liquid and a gas stream with lighter hydrocarbons and feeding said liquid stream into the bottom (28) of said fractionation column (25, 29, 28);

h. mixing said gas stream of step g with the separated gas phase of step e and feeding said mixture of gases to the bottom of the top section (25) of the fractionation column (25, 29, 28);

i. withdrawing liquid stream from the intermediate section (29) and pumping said liquid stream into the top section (25) of said fractionation column (25, 29, 28);

j. indirectly cooling gas exiting said top section (25) of said fractionation column (25, 29, 28) with cold residual gas drawn from said intermediate section (29) of said fractionation column (25, 29, 28);

k. separating from said cooled gas of step j liquid condensates and a gas stream;

l. feeding said gas stream of step k to said second stage (36) of said expansion turbine;

m. mixing the expanded gas stream of step l and the liquid condensates of step k and feeding the mixture into an upper section of said intermediate section (29) of said fractionation column (25, 29, 28);

n. withdrawing gas produced in the bottom section (28) of said fractionation column (25, 29, 28) and indirectly cooling said gas with residual gas from the top portion of the intermediate section (25) before feeding said cooled gas to the lowest portion of said intermediate section (29) of said fractionation column (25, 29, 28);

o. withdrawing from said intermediate section (29) of said fractionation column (25, 29, 28) said residual gas;

p. indirectly heating said residual gas of step o by yielding negative calories to: (1) said gas existing in said top section (25) of said fractionation column (25, 29, 28) of step j; (2) said gas of step n withdrawn from the bottom section (28) of said fractionation column (25, 29, 28); (3) said cooled separated gas phase of step d; and (4) said natural gas feed stream of step a; and q. fractionating in the bottom section (28) of said fractionation column (25, 29, 28) liquids coming from the top section (25), the liquid stream of step g, and the condensates of step c, the heat required for the fractionation being supplied by a bottom reboiler (50) and by one or more lateral reboilers (12).

* * * * *

UNITED STATES PATENT AND TRADEMARK OFFICE

CERTIFICATE OF CORRECTION

PATENT NO. : 4,453,956

DATED : June 12, 1984

INVENTOR(S) : Cesare Fabbri et al.

It is certified that error appears in the above-identified patent and that said Letters Patent is hereby corrected as shown below:

Col. 6, line 62, "colories" should read --calories--.

Signed and Sealed this

Second Day of October 1984

[SEAL]

*Attest:*

GERALD J. MOSSINGHOFF

*Attesting Officer*

*Commissioner of Patents and Trademarks*